US005595468A

United States Patent [19]

Wald

[11] Patent Number: 5,595,468

[45] Date of Patent: Jan. 21, 1997

[54] EMPTY BAG FEEDER FOR PACKAGING MACHINES

[75] Inventor: Ulrich Wald, Hassloch, Germany

[73] Assignee: Paper Converting Machine GmbH, Schifferstadt, Germany

[21] Appl. No.: 446,385

[22] Filed: May 22, 1995

[30] Foreign Application Priority Data

May 20, 1994 [DE] Germany ..... 44 17 689.9

[51] Int. Cl.[6] ..... B65B 43/12

[52] U.S. Cl. ..... 414/331; 53/571; 53/572

[58] Field of Search ..... 414/331; 108/54.1, 108/11, 137; 53/571–573, 459, 386.1

[56] References Cited

U.S. PATENT DOCUMENTS

| | | | |
|---|---|---|---|
| 201,049 | 3/1878 | Robertson | 414/331 |
| 4,806,072 | 2/1989 | Karashima | 414/331 X |
| 4,808,057 | 2/1989 | Chiappe et al. | 414/331 X |
| 4,824,310 | 4/1989 | Kosmowski et al. | 414/331 X |
| 5,032,053 | 7/1991 | Krieg | 414/331 X |
| 5,265,397 | 11/1993 | DePoint et al. | 53/571 X |
| 5,388,532 | 2/1995 | Wakano | 108/54.1 X |

FOREIGN PATENT DOCUMENTS

| | | | |
|---|---|---|---|
| 362579 | 4/1990 | European Pat. Off. . | |
| 2665150 | 1/1992 | France | 414/331 |
| 2051841 | 4/1972 | Germany | 108/54.1 |
| 9200372 | 5/1992 | Germany . | |
| 4143342 | 1/1993 | Germany . | |
| 87429 | 3/1989 | Japan | 414/331 |
| 153123 | 5/1992 | Japan | 414/331 |
| 8204411 | 6/1984 | Netherlands | 414/331 |
| 1188352 | 4/1970 | United Kingdom . | |
| 2088334 | 6/1982 | United Kingdom . | |

*Primary Examiner*—David A. Bucci

*Attorney, Agent, or Firm*—Panitch Schwarze Jacobs & Nadel, P.C.

[57] ABSTRACT

A device for feeding a packaging machine via a bag stack feeder possesses at least one holder to secure a stack of bags. To date an operator placed the corresponding empty bags in stacks on a chain conveyor which fed the bags into the packaging machine. Due to the short cycle time, the manual loading tied an operator continuously to the machine. In order to avoid this, a bag stack feeder is equipped with a plurality of tray-like carriers, each fitted with a holder and each being detachable from the bag stack feeder. These carriers are respectively stored in large numbers in a magazine, which is exchangeable as a unit.

10 Claims, 6 Drawing Sheets

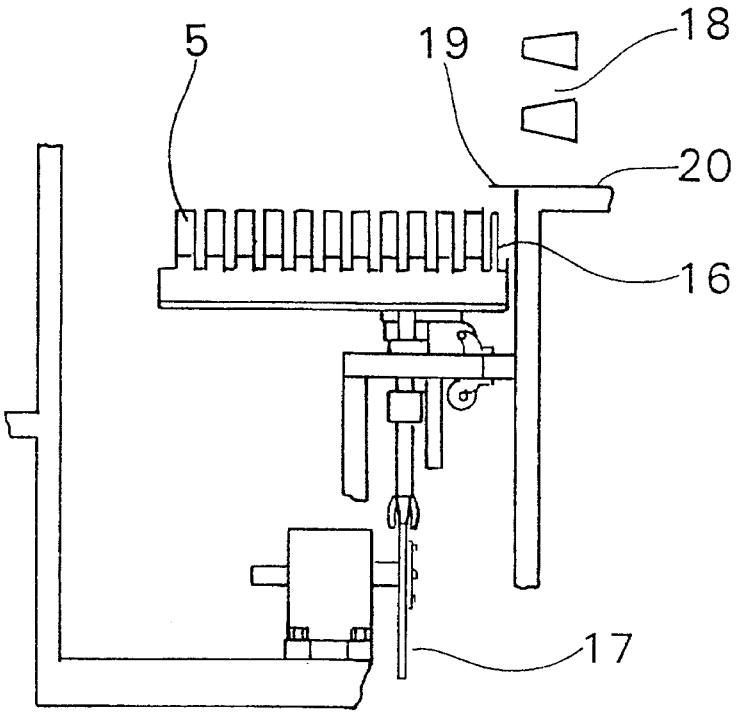
Fig. 4
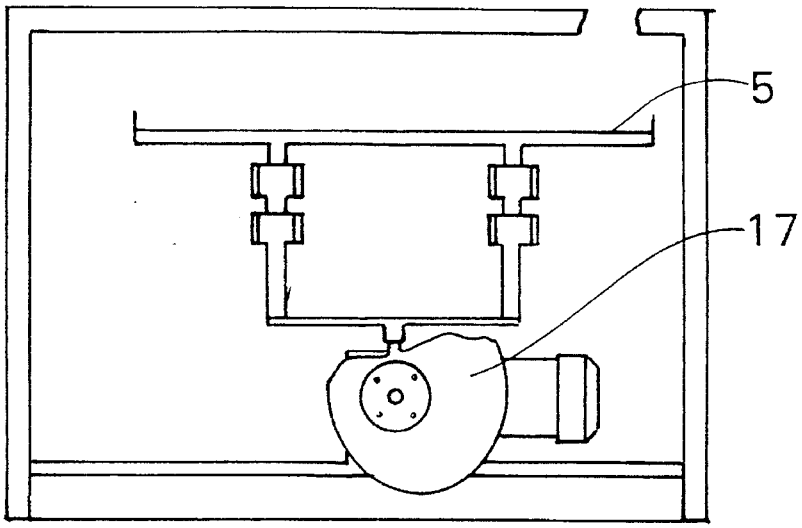
5 Fig.

EMPTY BAG FEEDER FOR PACKAGING MACHINES

FIELD OF THE INVENTION

The invention relates to a device for feeding empty bags into a packaging machine with a bag stack feeder equipped with at least one holder to secure a stack of bags.

BACKGROUND OF THE INVENTION

To date the empty bags, which are bundled in stacks of approximately 50 to 100 pieces, have been fed into the packaging machine using a chain conveyor. Here, the chain conveyor possesses bolts that serve as holders from which the stacks of bags are suspended. For this purpose, the bags are fitted on their opening side with a projecting bracket that has holes corresponding to the bolts. Via the chain conveyer, the stack of bags is fed into the packaging machine, where the bags are individually filled and pulled off from the stack. Should a stack be completely depleted, then the chain conveyor goes one cycle further and feeds the next stack of bags into the packaging machine.

Stocking the chain conveyor with new stacks of bags was until now always handled strictly manually, whereby, due to the high cycle number of the packaging machine, the operator already had to place the next stack on after only approximately 1½ minutes. In the event a placement of two or more stacks of bags on the chain conveyor is possible, the time span between individual servicings is increased correspondingly. In order to ensure continuous operation of a packaging machine, an operator must therefore always attend the machine. Accordingly, an object of the invention is to decrease the manual labor pool on the packaging machine without, at the same time, increasing space requirements.

SUMMARY OF THE INVENTION

According to the invention, this object is achieved by the bag stack feeder having a plurality of tray-like carriers, each fitted with a holder to secure a stack of bags, and each being detachable from the bag stack feeder as well.

Since a large number of tray-like carriers is provided for at a time, several stacks of bags can be prepared for feeding into the packaging machine, so that the operator must be called upon only when all the carriers have been emptied. In addition, large stacks of bags can be stored on the tray-like carriers, so that the cycle time is longer before the next stack of bags is brought in. Due to the tray-like carriers, a space-saving configuration of several stacks of bags in front of the packaging machine is thus possible.

This can be achieved in particular since a carrier filled with a stack of bags prior to attachment to the bag stack feeder can be removed from the device's storage unit, which contains several carriers. Thus, a simpler kinematics is made possible for transporting a stack of bags without additional transfers.

The carrier is then run in the packaging machine until empty, and detached once again from the bag stack feeder. The carrier can be redeposited in a storage unit. Here the storage unit for the empty carrier can indeed be the same storage unit from which the full carrier was removed. However, it is advantageous for the empty carrier to be held in a different storage unit after the stack of bags is removed from it.

In order for the removal or withdrawal of the filled carrier and/or deposit of the empty carrier in the given storage units to be able to proceed in a simple fashion, the given storage units can be transported at right angles to the storage and removal direction, so that storage as well as removal is possible at the same location in the device. Thus, the carriers can always be transported directly into and/or out of the storage unit, without having first to be turned around on their way to their storage location.

The storage units can, for example, be conveyor belts, in which two or four conveyor belts, engaging the sides or edges of the carrier, move synchronously, and the carriers can be removed at right angles to these moving directions. It is, however, also possible to stack the individual carriers directly atop one another in the storage unit, and not to hold them on separate rack rails. However, with separate rack rails the carriers cannot block each other and this serves operational safety.

In a preferred embodiment, the storage units contain exchangeable magazines, in which several carriers can be held at one time. It is thereby possible to prepare a corresponding magazine with filled carriers, and to exchange the complete magazine at the machine. This involves considerably less time than exchanging each individual carrier.

The carriers of the stack of bags are characterized in particular in that their carrying length can be altered. In stacks of bags with bottom folds, this has the advantage that the carrying length of the carrier can be adjusted in such a manner that the thicker end of the bag, where the bottom fold is located, does not lie on the carrier. Thus, a bulge protruding upwards on the stack end is avoided, which could lead to difficulties in the transport of the stack of bags into the packaging machine, as well as in filling the bags.

For this purpose, the carrier can be made of a smooth sheet metal that can be shortened via sliding parts. In a preferred embodiment, in which the tray-like carrier is made up of a laterally opening grate to adjust the carrying length, individual grate rods can be added or removed to a base frame of the carrier. Here the grate-like construction offers the advantage that the bags lying on the carrier can be scooped up via a fork left entering the carrier from the side, so that the carrier is then lowered, allowing it to be exchanged for a new, full bag carrier, without causing an interruption in operation, since during the exchange time the remaining bags lying on the fork lift are filled.

As regards the holder to secure a stack of bags on the carrier, preferably there extends essentially perpendicular to the carrier a pin whose length is adjustable. In particular, this pin can possess a spring element counteracting the change in length. In conjunction with a corresponding stop on the packaging machine, one ensures that, while the stack of bags is worked through, the upper edge of the pin does not extend beyond the level of the topmost bag. Thus, one avoids having the pin extend into the bag's interior and ripping open the product to be put into the bag.

BRIEF DESCRIPTION OF THE DRAWINGS

The foregoing summary, as well as the following detailed description of a preferred embodiment of the invention, will be better understood when read in conjunction with the appended drawings which show further features and advantages of the invention. For the purpose of illustrating the invention, there is shown in the drawings an embodiment which is presently preferred. It should be understood, however, that the invention is not limited to the precise arrangements and instrumentalities shown. In the drawings:

FIG. 4 shows a carrier in the packaging machine according to the invention in a side view;

FIG. 5 shows a carrier in the packaging machine according to the invention in a front view;

DETAILED DESCRIPTION OF PREFERRED EMBODIMENT

Figure 1:
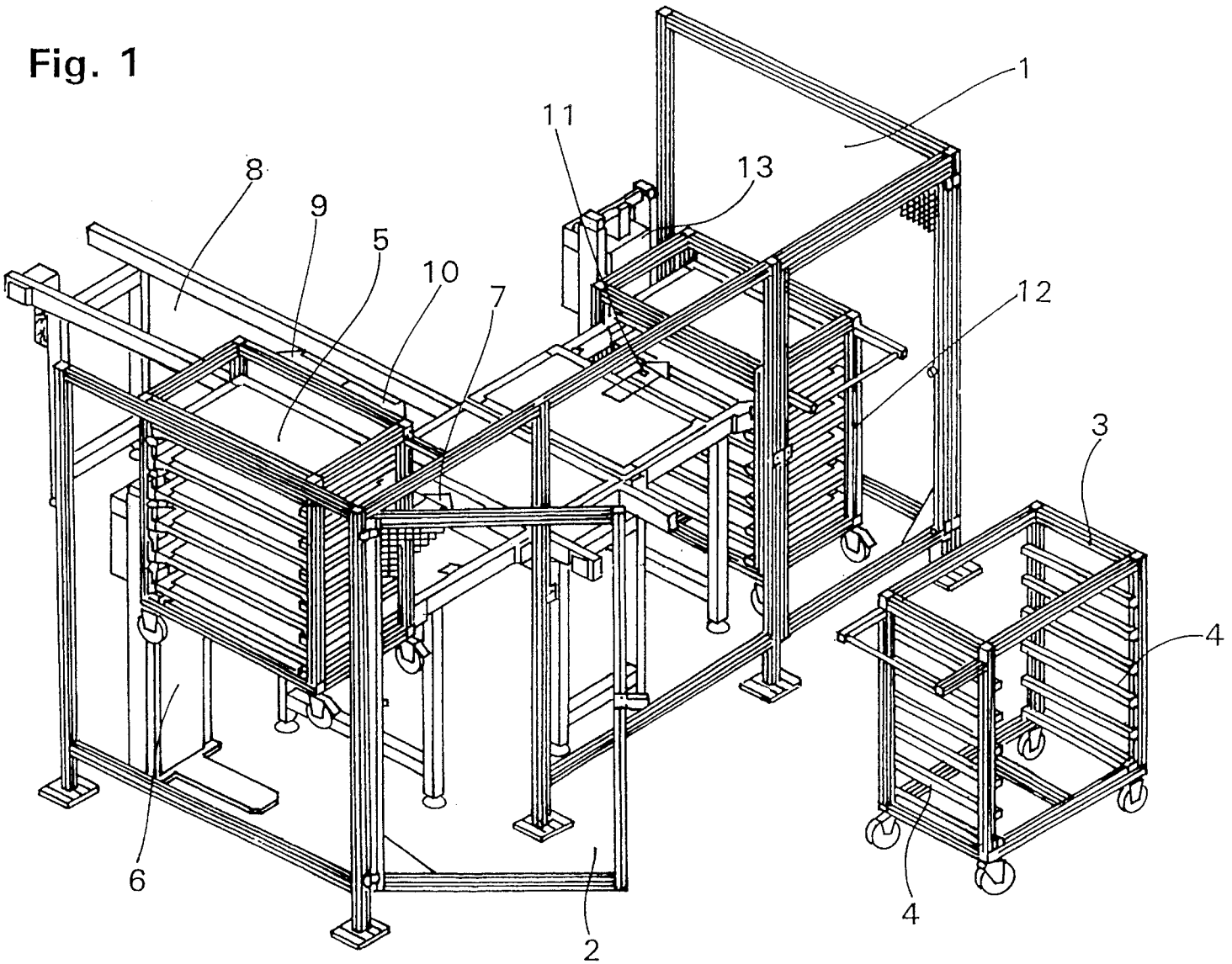
FIG. 1 shows a feeding device according to the invention in a view diagonally from above.

FIG. 1 illustrates a feeding device for empty bags, according to the invention, for a packaging machine not depicted in greater detail. A protective grating guards the feeding device from undesired contact. After opening grate door 2, a magazine cart, as represented in front under reference number 3, can be moved into the device.

This magazine cart possesses on its narrow sides rack rails 4, arranged in pairs, onto which additional tray-like carriers 5, described below in greater detail, can be inserted. The tray-like carriers are stocked in advance with empty bags by an operator. The corresponding filled cart, inserted into the machine, is then lifted via a hoisting device 6, so that the lowest carrier is to be removed from the magazine cart in the arrow direction 7, in order to link it with the packaging machine's bag stack feeder. Associated with the bag stack feeder is a feed conveyor 8, which is pictured here as a linear longitudinal conveyor, but which could also be designed as a belt conveyor or chain conveyor.

The carrier is inserted via these feed conveyors 8 along arrow direction 9 into a packaging machine, not shown. There the carrier is transported in a bag-removal-position, and the bags located on the carrier are filled and removed from the carrier by pulling off.

The emptied carrier is then conveyed back along arrow direction 10 of the feed conveyor 8 and, as indicated by arrow 11, inserted into another magazine cart 12, which is also adjustable in terms of height to the feed conveyor via a corresponding hoisting device 13. Via the hoisting device 13, the magazine cart 12 is lowered and/or raised so that one empty tray-like carrier after another is placed upon a pair of rack rails. At the same time, the first magazine cart is lowered via a hoisting device 6 far enough so that the next carrier stocked with bags is removed and can be fed into the packaging machine. The empty carrier is similarly transported back to the second magazine cart 12.

After magazine cart 12 is filled with empty carriers, hoisting device 13 places it down on the ground, and magazine cart 12 can be removed from the device by an operator, and be replaced by an empty magazine cart. The empty carriers of magazine cart 12 are then re-stocked with stacks of bags, and the thus-filled magazine cart is exchanged for the first-mentioned magazine cart, when all carriers are removed from this.

Figure 2:
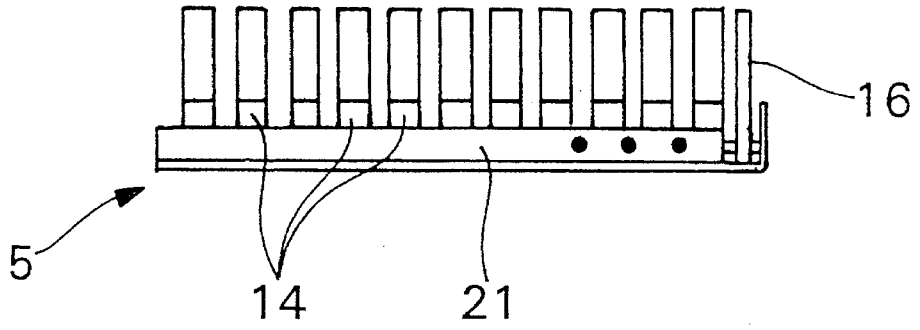
FIG. 2 is a side view of a carrier belonging to the invention.
Figure 3:
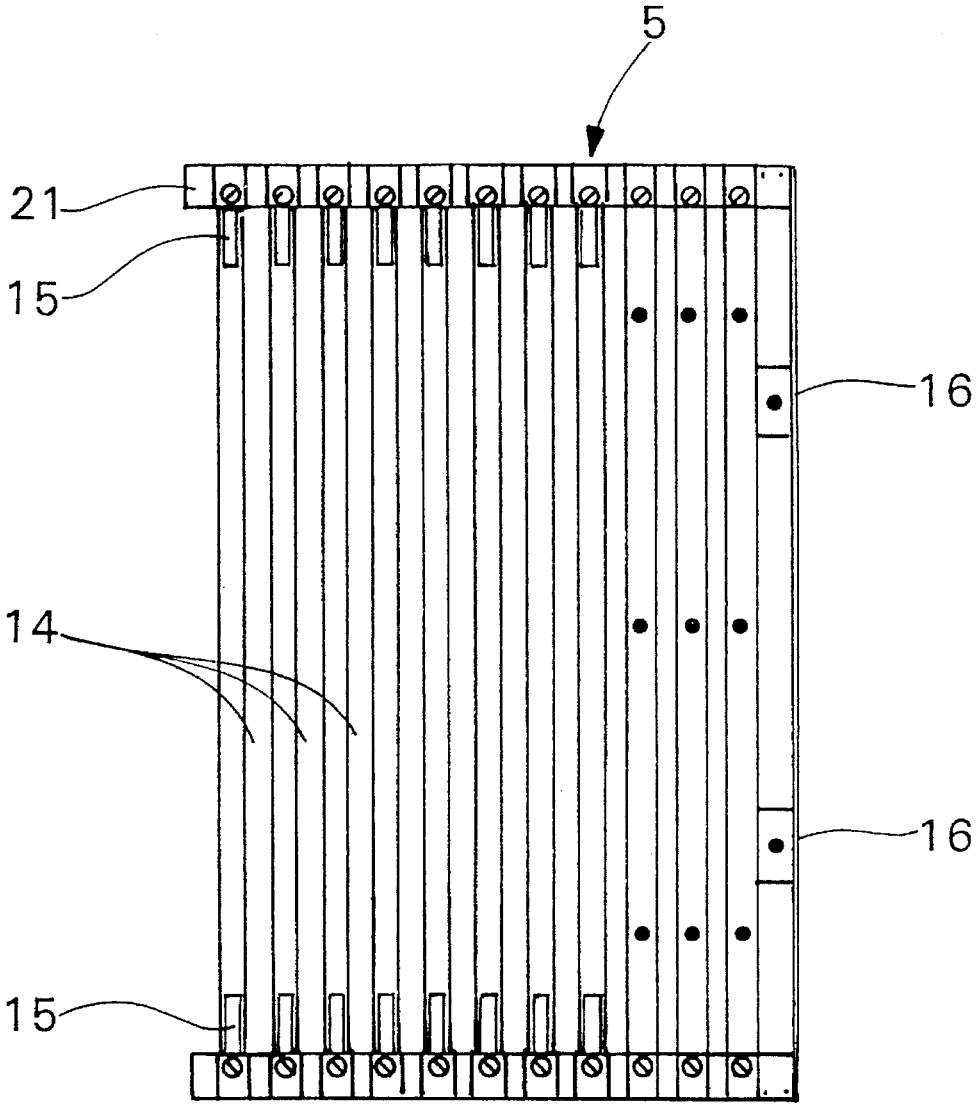
FIG. 3 shows a top view of a carrier corresponding to FIG. 2.
Figure 8:
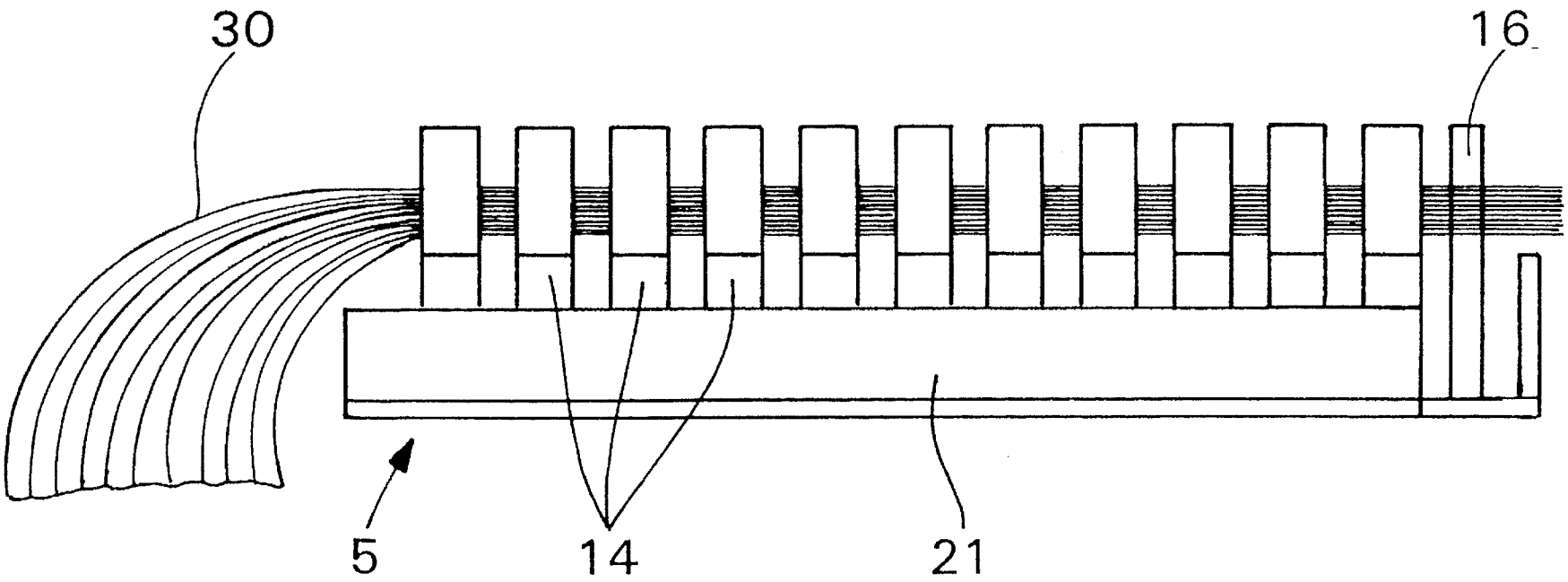
FIG. 8 is a side view similar to FIG. 2 of a carrier stacked with bags.
Figure 9:
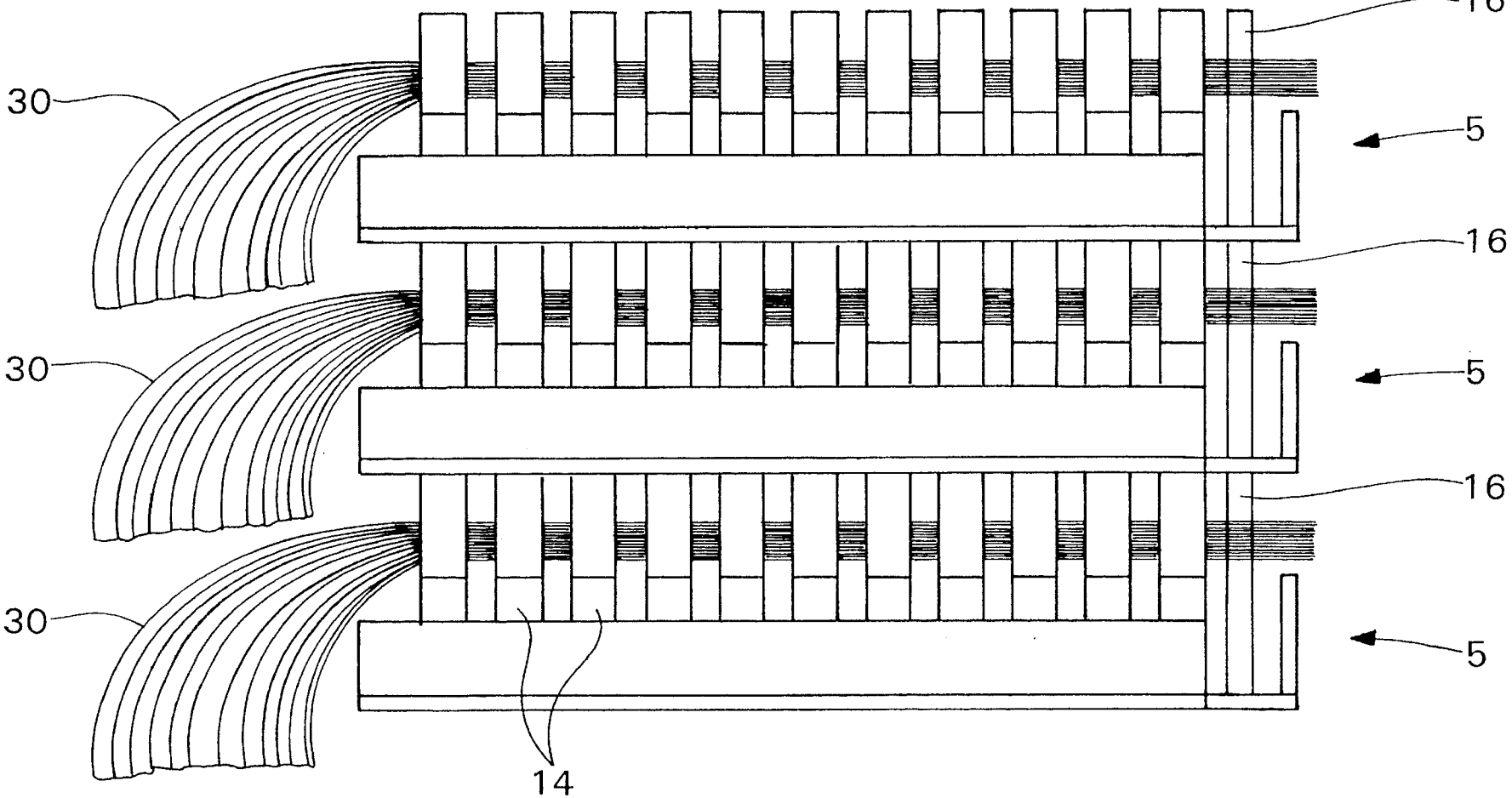
FIG. 9 is a side view of carriers stacked directly atop one another.

In FIGS. 2, 3 and 8 a suitable tray-like carrier 5 is depicted. The carrier has a grate-like floor made up of several individual rods 14 that lie on a base frame 21. These individual rods 14 are mounted laterally on their ends on pressure pieces 15 so that they can be easily mounted or dismounted. The supporting length of the carrier can thereby be adjusted according to the bags 30 used. Here it must be taken into consideration that the bags 30 generally possess a bottom fold on the closed end and, therefore, are thicker there than at their other open end. Thus, based on the adjustable length of the carrier, this thicker end hangs down freely, and no bulge forms as shown in FIG. 8. As shown in FIG. 9, the carriers 5 in a storage unit, such as the magazine cart 3, can be directly stacked atop one another.

From the lateral view of the carrier 5 depicted in FIG. 2, one can see that its lateral walls are slotted, thus enabling the carrier to be removed from the machine prior to the removal of the last bag. To this end, on one or both sides, a machine fork moves into the slots of the lateral walls and scoops up the remaining stack of bags. Carrier 5 can then be lowered and, without having to interrupt operation, replaced by a new, full bag carrier.

On its front end, the tray-like carrier possesses retention pins 16 from which the stack of bags can be suspended. These retention pins 16 are mounted vertically with spring action. As depicted in FIG. 4, namely while the bags are worked through, carrier 5 is raised gradually via a cam disk 17, so that the upper bag level always remains constant, and thus also remains in the region of the filling opening 18. However, a spindle or the like can also be utilized in place of a cam disk.

However, on lifting, the retaining pins 16 also rise, and already after working, fewer bags extend into the bag interior, thus ripping open the products to be put into the bags. Therefore, a stop 19 is provided for these retaining pins 16. It can be seen on the illustration with the filling opening 18 and lies below the feeding tract 20 for the products to be packaged. It also does not hinder the opening of the uppermost bag, since the upper bag foil is designed somewhat shorter than those below it. Therefore, it does extend at all to the retaining pins and their stop. Thus, the upper bag foils can be hoisted by a suction strip, not depicted, or the like, while the lower bag wall which protrudes further, remains fixed between stop 19 and retaining pins 16. After the bag is filled, it is pulled away, in FIG. 4 to the left, whereby the foil is completely pulled off from the retaining pins. But it is not critical that they are thus destroyed, since the bag edge is subsequently sealed and separated.

The now empty carrier is then lowered, removed from the packaging machine, returned to the corresponding magazine for empty carriers, and then, together with this magazine, removed from the device for restocking.

Figure 6:
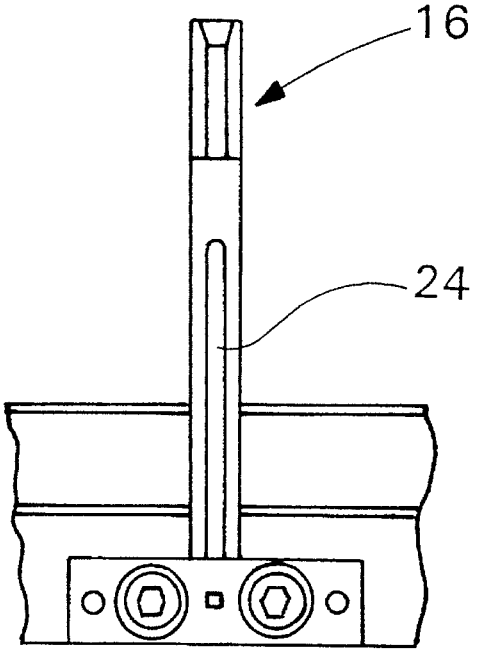
FIGS. 6 and 7 show a retention pin for stacks of bags as secured on a carrier.
Figure 7:
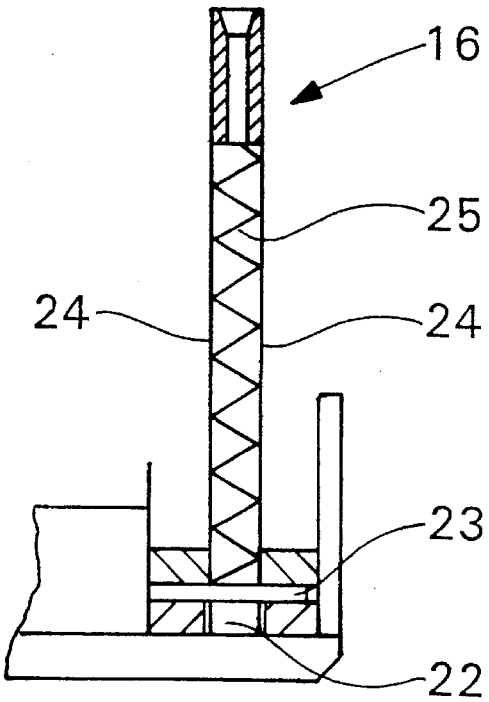

In FIGS. 6 and 7, a spring action retaining pin 16 is depicted in greater detail. The retaining pin is mounted in a guide 22. An adjusting pin 23, that extends through two slots 24 of the retaining pin 16, sits in this guide. In the hollow interior of retaining pin 16 is located a spring 25 which sits between the adjusting pin 23 and the closed cover of the retaining pin 16. Upon lowering of the retaining pin 16 slots 24 slide downwardly along adjusting pin 23, thus compressing spring 25. When the pressure on retaining pin 16 is relieved, the spring 25 pushes the pin back to its original position.

It will be appreciated by those skilled in the art that changes could be made to the embodiments described above without departing from the broad inventive concept thereof. It is understood, therefore, that this invention is not limited to the particular embodiment disclosed, but it is intended to cover modifications within the spirit and scope of the present invention as defined by the appended claims.

I claim:

1. A device for feeding empty bags into a packaging machine comprising a bag stack feeder which comprises a plurality of carriers (5), each equipped with a holder (16), each carrier being detachably connected to the bag stack feeder, each carrier comprising a laterally open grate having a plurality of spaced apart rods such that a machine fork can be positioned between the spaced apart rods, and the carrier can be lowered with the stack of bags remaining on the machine fork.

2. The device according to claim 1, further comprising a first storage unit for containing several carriers, wherein each carrier (5) equipped with a stack of bags can be taken out of storage prior to attachment to the bag stack feeder (8) from the first storage unit (3) for containing several carriers.

3. The device according to claim 2, further comprising a second storage unit, wherein each carrier (5), after removal of a bag stack, can be placed in the second storage unit (12).

4. The device according to claim 3, further comprising means for transporting the first and second storage units at right angles to one of a storage deposit direction and a storage removal direction, wherein the storage units are transportable at right angles to one of the storage deposit direction (11) and the storage removal direction (7), and the deposit into and removal from storage is possible at one location.

5. The device according to claim 2, wherein the storage unit comprises an exchangeable magazine (3, 12) in which several carriers (5) can be held simultaneously.

6. The device according to claim 2, wherein the carriers in the storage unit are directly stacked atop one another.

7. A carrier for a feeding device according to claim 1, wherein the carrier a horizontal-lying carrying length which can be altered.

8. The carrier according to claim 7, wherein the carrier (5) is constructed of a laterally open grate, and individual grate rods (14) can be added to or removed from a base frame (21) to change the carrying length.

9. The carrier according to claim 7, wherein the holder (16) to secure a stack of bags is a pin extending essentially perpendicular to the carrier, the pin being adjustable in length.

10. The carrier according to claim 9, wherein the pin (16) possesses a spring element to counteract length adjustments.

* * * * *